US005156276A

United States Patent [19]

Lebowitz

[11] Patent Number: 5,156,276

[45] Date of Patent: Oct. 20, 1992

[54] PACKAGE WITH PRODUCT DISPLAY

[75] Inventor: Samuel Lebowitz, New York, N.Y.

[73] Assignee: Wilton Industries, Inc., Woodridge, Ill.

[21] Appl. No.: 772,565

[22] Filed: Oct. 8, 1991

[51] Int. Cl.[5] ..... B65D 85/44

[52] U.S. Cl. ..... 206/588; 206/45.14; 229/162

[58] Field of Search ..... 206/44 R, 45.14, 45.19, 206/45.31, 588, 590; 229/162

[56] References Cited

U.S. PATENT DOCUMENTS

| | | | |
|---|---|---|---|
| 2,646,165 | 7/1953 | Whitehead | 206/590 |
| 2,744,622 | 5/1956 | Sparks | 206/590 |
| 2,868,428 | 1/1959 | Bergstrom | 206/588 |
| 3,545,664 | 12/1970 | Robinson | 206/588 |
| 3,741,380 | 6/1973 | Carney | 206/45.14 |
| 3,837,479 | 9/1974 | Lehmann | 206/590 |
| 3,887,067 | 6/1975 | Collura et al. | 206/45.14 |
| 3,917,064 | 11/1975 | Roccaforte | 206/45.14 |
| 4,201,293 | 5/1980 | Rigazio | 206/523 |
| 4,385,687 | 5/1983 | Dutcher | 206/45.14 |

FOREIGN PATENT DOCUMENTS

| | | | |
|---|---|---|---|
| 2160508 | 12/1985 | United Kingdom | 206/44 R |

OTHER PUBLICATIONS

"China 'Floats' In Unique Display Rack", Packaging News And Trends, *Packaging* vol. 31, No. 10. Sep. 1986, p. 12.

*Primary Examiner*—Jimmy G. Foster
*Attorney, Agent, or Firm*—James P. Ryther

[57] ABSTRACT

A package for the point-of-purchase display of a product wherein the package comprises a combination of a container section, a pedestal section, and a retainer section. The container section comprises bottom and top walls with upstanding side walls. One of the side walls defines an opening which permits viewing of the product located within the container. The pedestal section overlies the bottom wall, and the product within the package is held in place by the pedestal section. The retainer section extends upwardly relative to the pedestal section, and provides a cutout portion for engagement with the product supported by the pedestal section. This retainer section holds the product against vertical shifting movement while the pedestal section is holding the product against lateral shifting movement. In the preferred form of the invention, the respective sections are all formed from one-piece blanks.

12 Claims, 5 Drawing Sheets

FIG. 6
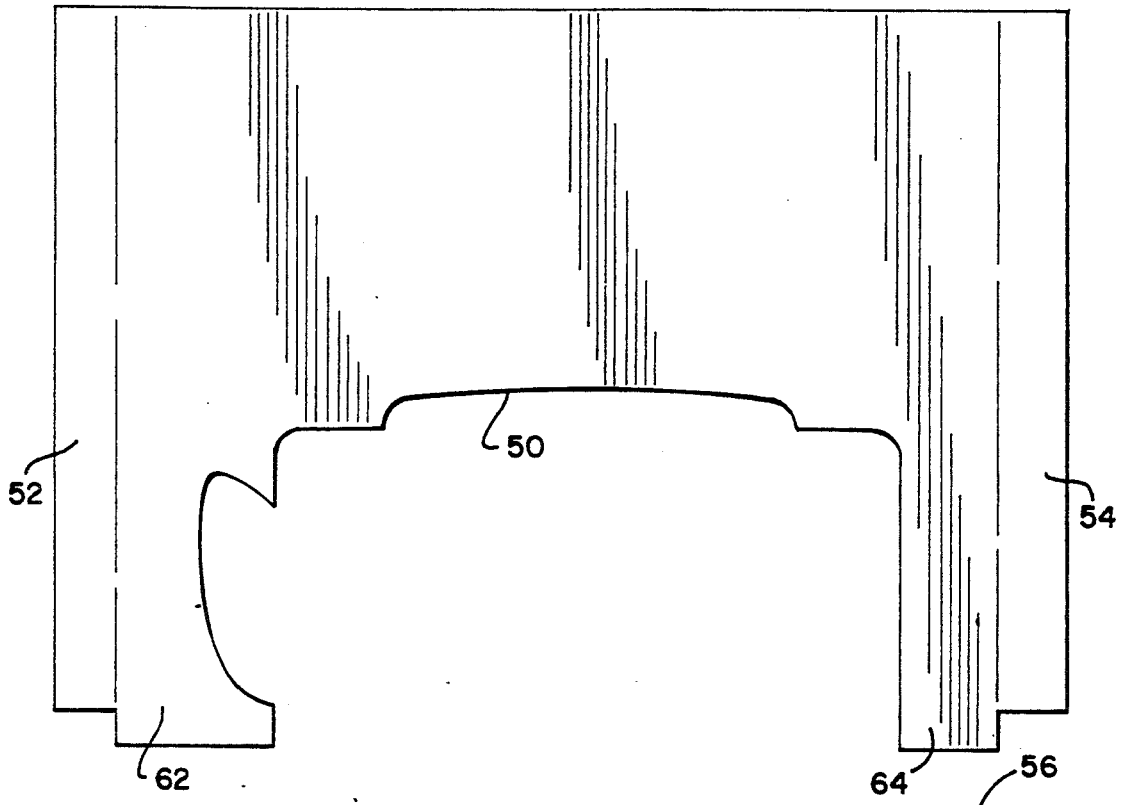
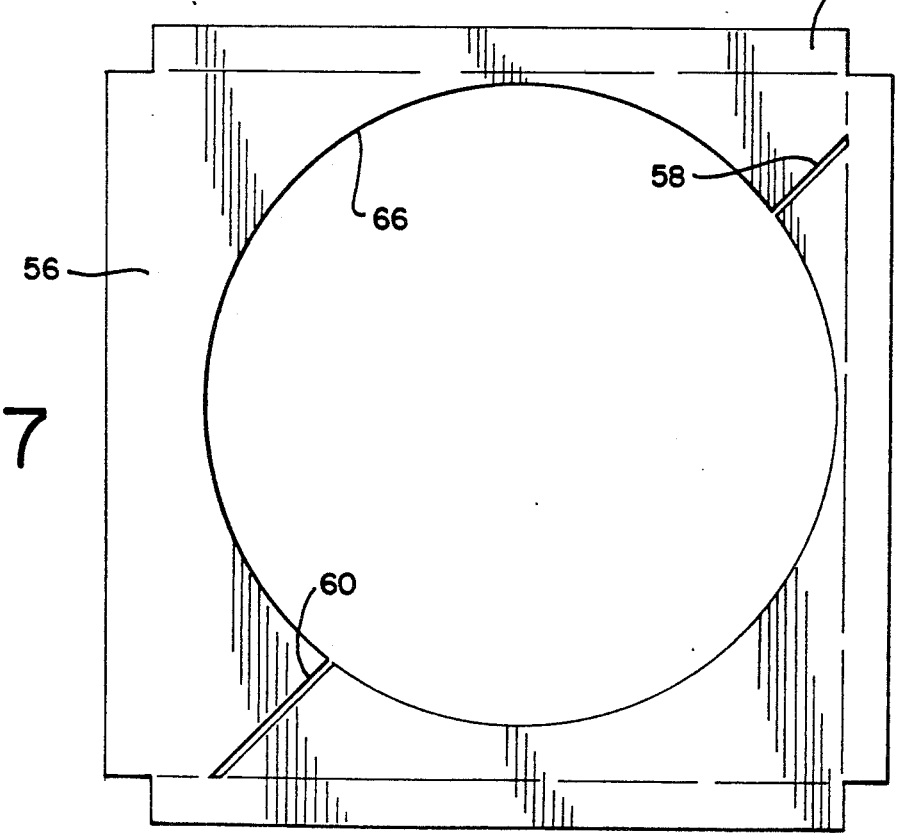
FIG. 7

PACKAGE WITH PRODUCT DISPLAY

BACKGROUND OF THE INVENTION

This invention relates to a package particularly designed for the point-of-purchase display of a product. The invention will be described with respect to the display of cookware, such as a tea kettle, and the package is primarily suited for the retail display of such products. It will be appreciated that other applications of the concepts of the invention are possible.

Particularly with respect to retail sales, it is always desirable to provide attractive packaging means. One primary consideration in this regard is that the product being displayed be exposed for viewing as completely as possible so that the potential purchaser will be able to adequately inspect the product. For efficiency reasons, it is desirable that this be accomplished without removing the product from its package.

It is also of great importance that the packaging design be such that the product is securely held so that the product will not be damaged during shipping or during handling by employees and customers. As will be appreciated, it is difficult to provide the combination of complete display of a product for viewing by a potential purchaser while at the same time providing a package which will protect the product against damage.

The provision of a package which secures the product during shipping and handling is also advantageous from the standpoint of efficient retail operations. Specifically, products packaged in this fashion can be placed in a shopping bag or otherwise easily wrapped by a sales person without the need for additional security during handling by the consumer.

SUMMARY OF THE INVENTION

The present invention prodvides a package for the point-of-purchase display of items such as cookware. The combination of elements making up the package can be efficiently manufactured and assembled with the product while enabling the display of the product in a manner such that a potential purchaser can view all significant aspects of the product without removing the product from the package. In addition, the package design is such that the product is securely held within the package and, therefore, the product will not be damaged during ordinary shipping and handling. The package design also requires a minimum of wrapping by a sales person thereby enhancing retail operating efficiency.

The particular package of the invention comprises a combination of a container section, a pedestal section, and a retainer section. The container section, which is preferably formed from a one-piece blank, includes a bottom wall, upstanding side walls and a top wall. One of the side walls defines an opening which permits viewing of a product held within the package.

The pedestal section, also preferably formed from a one-piece blank, is located in overlying relationship with respect to the bottom wall of the container section. This pedestal section includes means for holding the product being displayed thereby preventing or at least minimizing any tendency towards lateral shifting of the product during shipping and handling.

The retainer section of the package is also preferably formed from a one-piece blank. This section extends upwardly from the pedestal section and includes a cutout portion for receiving the product held by the pedestal section. The cutout portion is designed for engaging the product being displayed to prevent or at least minimize any vertical shifting of the product.

The package is characterized by ease of assembly and use. Specifically, the one-piece blank forming the container section is adapted to be folded into the desired configuration of top, bottom and side walls. By providing suitable interengaging flaps, this container section can be secured in the folded relationship with a minimum of adhesive application or other securing steps. In addition, slots and tabs and engaging flaps are associated with the pedestal and retainer sections for simplified securing of these sections with respect to the container section.

In the course of packaging a product, a simple series of assembly steps is involved. Specifically, after the container section has been secured in a box-like configuration, the pedestal section is inserted. The product to be displayed may-then be located in position with respect to the pedestal section, and the retainer section then positioned over the product. Alternatively, and depending primarily on the product configuration, the product and retainer section, and possibly also the pedestal section, may be assembled outside the container section, and then placed as a unit in the container section.

The retainer section preferably includes tabs received by slots defined in the pedestal section for secure positioning of the retainer section relative to the pedestal section. After the product and retainer section are in place, the top flaps of the container section are folded in to serve the dual purpose of securing the retainer section in place and to close the top of the container section.

BRIEF DESCRIPTION OF THE DRAWINGS

FIG. 6 is a plan view of a blank utilized for forming the retainer section;

FIG. 7 is a plan view of a blank utilized for forming the pedestal section; and, FIG. 8 is a perspective view of the package with a product on display.

FIG. 1 illustrates package 10 which is specifically designed for use in the display of a tea kettle 12 as illustrated in FIG. 8. The following discussion will refer to sections of the package which are designed and dimensioned to accommodate the tea kettle. It will be understood, however, that these design features and dimensions will vary as different types of products are associated with the package.

FIG. 2 illustrates a partially assembled container section 14 of the package 10. FIG. 3 illustrates all three sections making up the package 10, these sections comprising the container section 14, pedestal section 16 and retainer section 18.

Figure 1:
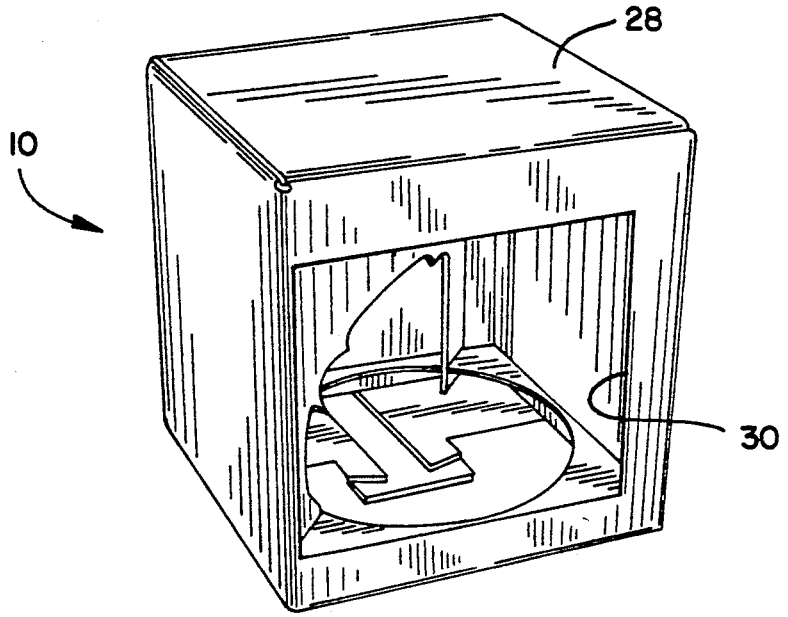
FIG. 1 is a perspective view of a package of the type contemplated by this invention.

The container section 14 consists of side walls 20, a bottom wall 22 and a top wall comprising flaps 24, 26 and 28. One of the side walls 20 defines opening 30 through which the tea kettle or other product can be seen by a purchaser.

Figure 5:
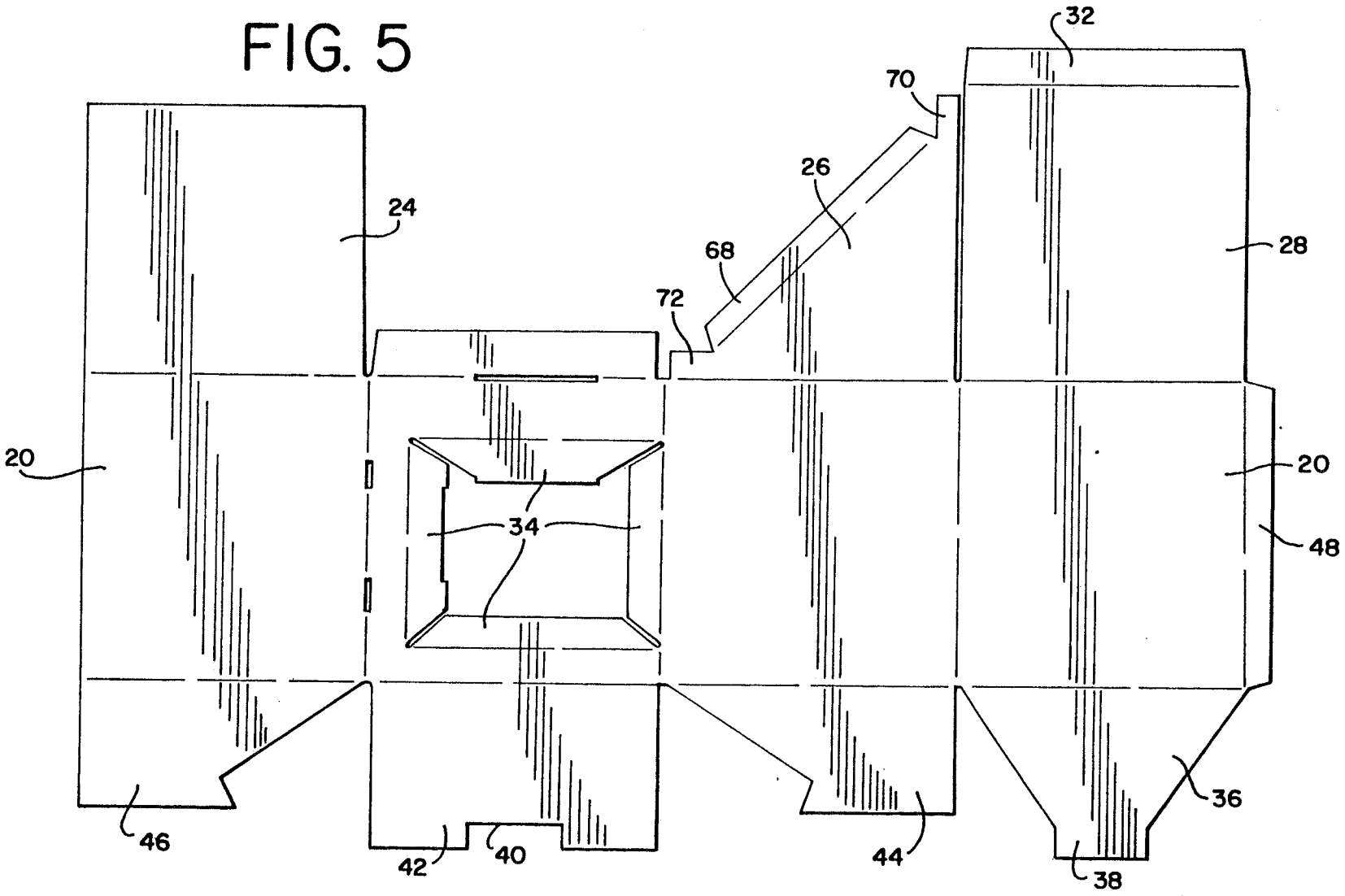
FIG. 5 is a plan view of a blank utilized for forming the container section.

FIG. 5 comprises a blank used for forming the container section 14. This blank, as well as the blanks used for forming the other sections is preferably composed of a standard cardboard material used for similar packaging applications. The concepts of the invention, however, can be employed in connection with other packaging materials including plastics and the like.

The blanks shown in FIG. 5 include upper portions making up top wall forming flaps 24, 26 and 28. The latter flap includes a tongue portion 32 which is adapted to be folded in a conventional fashion for holding the flap 28 in place when the package is closed.

Four intermediate portions of the container section blank are utilized for forming side walls 20 including the side wall utilized for providing the opening 30. In the formation of this portion of the blank, four foldable portions 34 are adapted to be bent inwardly about suitable fold lines to provide a neat frame-like appearance for the opening 30. Thus, the edges of the opening 30 will be formed by these folds rather than by die cut edges which presents a neater appearance.

Figure 2:
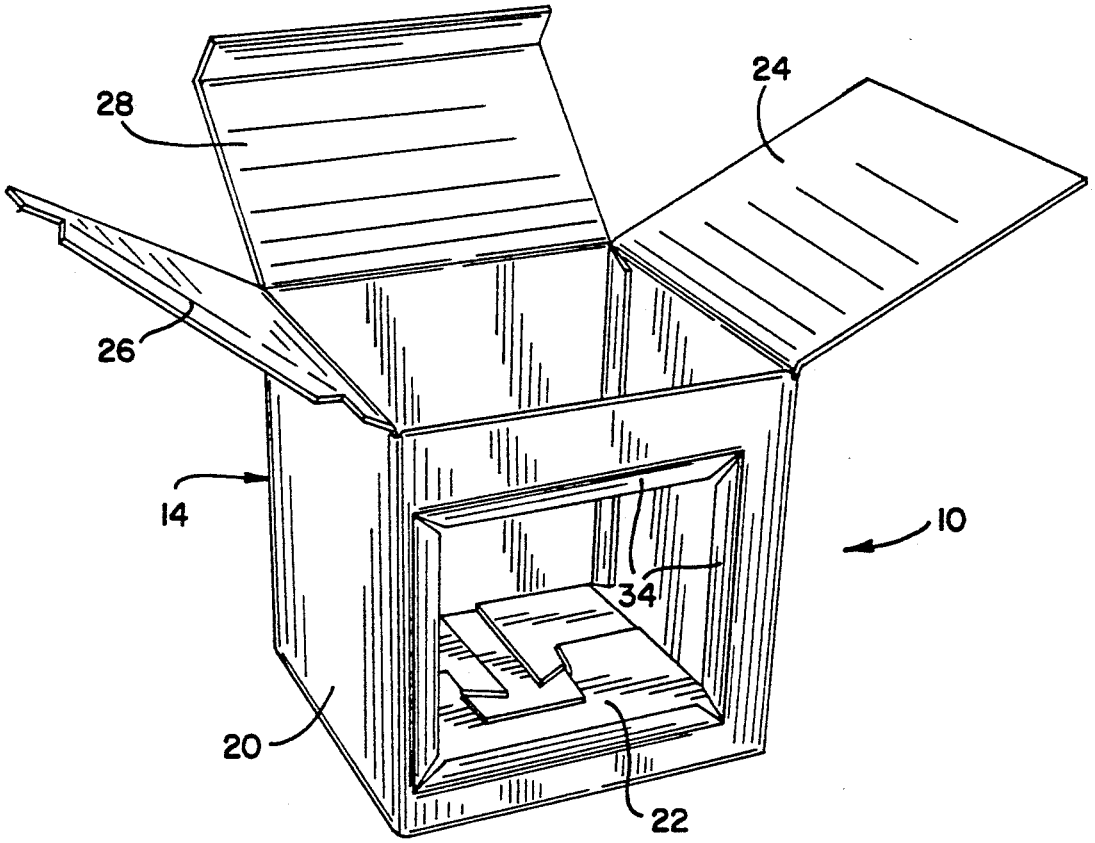
FIG. 2 is a perspective view of the container section of the package in a partially folded condition.

The lower portions of the blank shown in FIG. 5 interfit with each other to form bottom wall 22. As shown in FIG. 2, the flap portion 36 includes a tongue 38 which is received in the cutout portion 40 of flap portion 42. In the meantime, flap portions 44 and 46 are tucked between the portions 36 and 42 with the result that a secure relationship of these four parts is achieved with no necessity for an adhesive connection.

When the blank of FIG. 5 is folded into assembled relationship as shown in FIG. 2, the extension 48 of one side wall 20 is located in overlying relationship with the interface of another side wall 20 as shown in FIG. 2. An adhesive or other suitable connection is then provided between this extension 48 and that inner face to achieve a secure assembled relationship.

Figure 8:
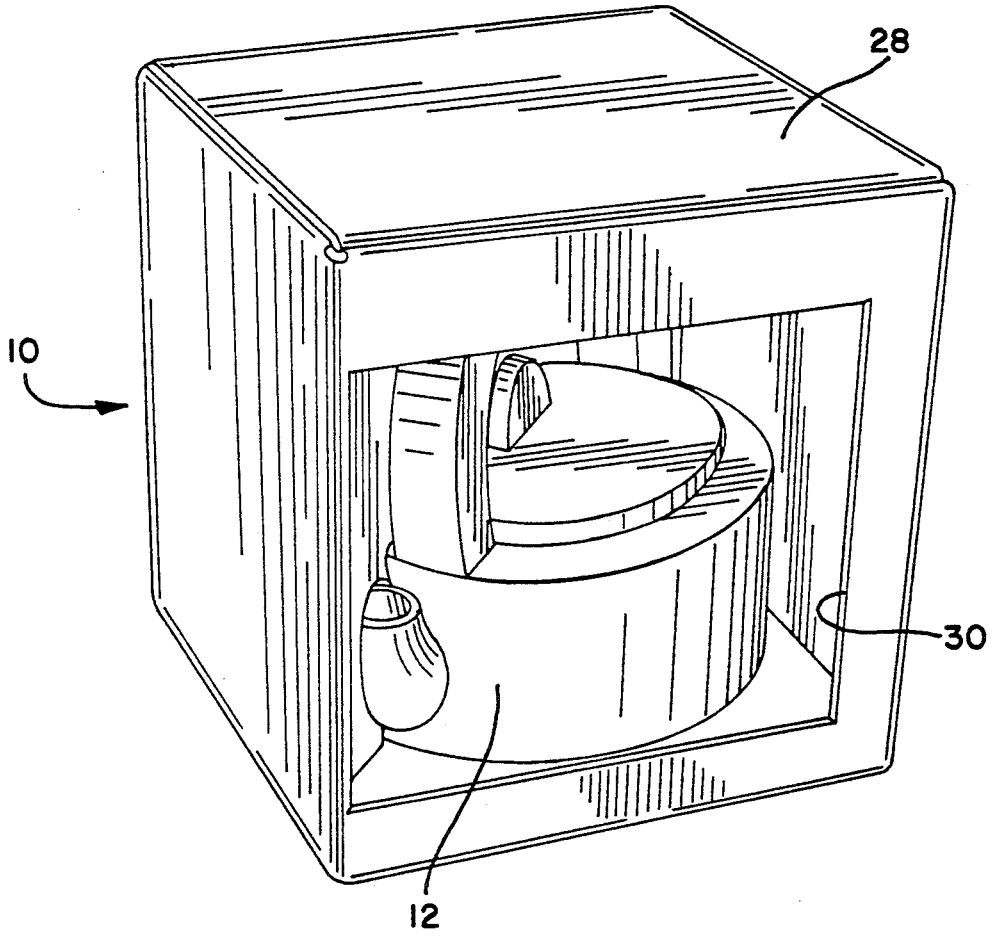

FIG. 6 illustrates the one-piece blank employed for forming retainer section 18. This retainer section defines a cutout portion 50 which is shaped in accordance with the contour of the tea kettle 12. The blank is dimensioned to extend angularly between corners of the container section 14. Extensions 52 and 54 of the blank are folded inwardly with the outer edges of these extensions engaging the corners of the container section. This results in the retainer section being offset rearwardly from a line drawn diagonally between the corners of the container section. With that arrangement, the handle of the tea kettle body and the handle for the tea kettle lid remain exposed for viewing as shown in FIG. 8.

FIG. 7 illustrates the blank employed for pedestal section 16. This blank includes extensions 56 which are adapted to be folded downwardly for retaining the pedestal in spaced relationship with bottom wall 22. The pedestal blank also includes slots 58 and 60 which are adapted to receive, respectively, feet 62 and 64 formed in the blank for retainer section 12. When these feet are in place in the slots, the retainer section is fixed in position relative to the pedestal.

Figure 3:
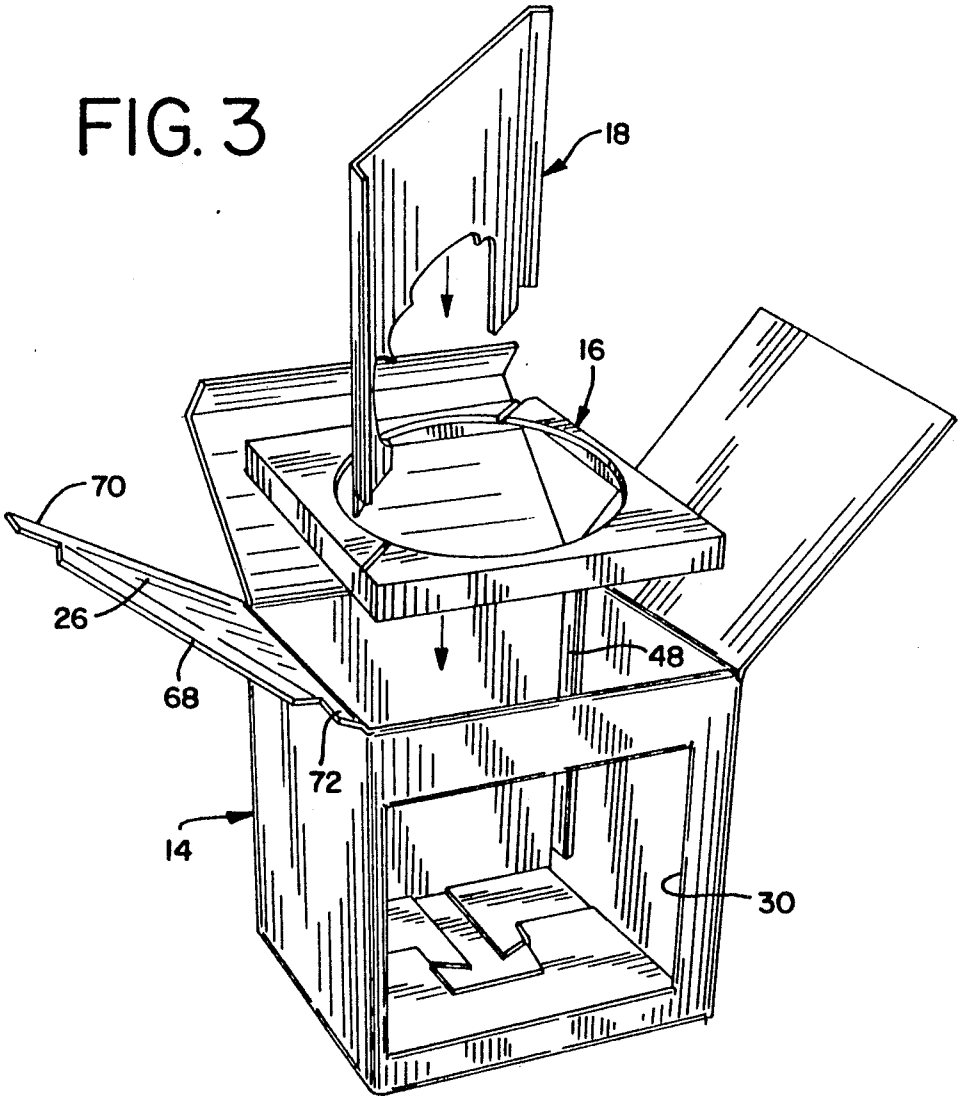
FIG. 3 is an exploded view illustrating the container pedestal and retainer sections of the package.

As best shown in FIG. 3, the package of the invention is utilized by first folding the blank for container section 14 and securing the extension 48 thereof relative to a side wall 20. The pedestal section 16 is then placed in the container section adjacent the bottom wall 22. It will be noted in this connection that the extension 48 extends short of the bottom wall 22 so that the pedestal section can be pushed into position beneath the bottom edge of the extension 48 to thereby assist in holding the pedestal section against upward movement.

To locate a product such as the tea kettle 12 in the package, the product is positioned within the opening 66 defined by the pedestal section. In the case of the tea kettle 12, this opening is circular and is dimensioned in accordance with the tea kettle diameter so that no significant lateral shifting of the tea kettle will take place.

Figure 4:
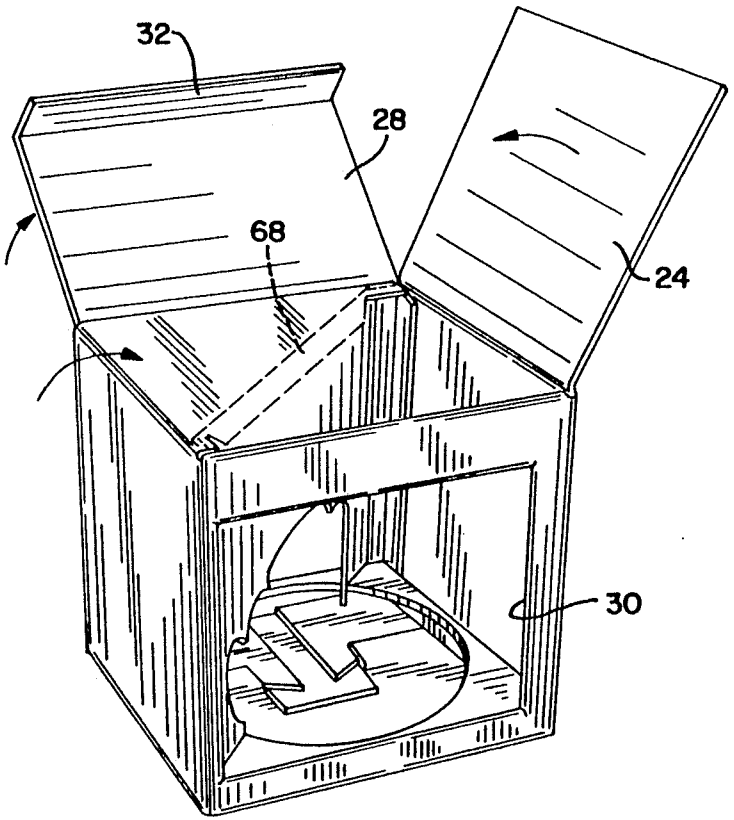
FIG. 4 is a perspective view of the package with the top flaps partially open.

As indicated, the retainer section 18 is assembled with the container section and pedestal section. In particular, the feet 62 and 64 are located in slots 58 and 60, and the extensions 52 and 54 are positioned relative to the corners of the container section. It will be noted that the retainer section extends upwardly to the top of the container section. Flap 26 of the container section includes an extension 68 which is adapted to interfit with the retainer section after the latter is in place. As shown in FIG. 4, the extension 68 is preferably folded over and tucked in behind the retainer section. Corner portions 70 and 72 of the flap 26 will in turn be positioned on top of the upper edge of the retainer section to form a secure connection between the flap 26 and the retainer section.

Once these steps have been completed, the flap 24 is placed over the flap 26, and the cover lid 28 is placed over the flap 24. Extension 32 is then tucked in to achieve the complete assembled relationship shown in FIG. 28.

Assembly of the retainer section with the pedestal section may take place after the product is in position. Alternatively, for example in the case of tea kettle 12, the retainer section may first be assembled with the product, and the two located simultaneously in position relative to the pedestal section.

It will be appreciated that the container section 14 can be used in conjunction with a variety of pedestal and retainer sections. For example, tea kettles or other cookware with a non-circular base could be positioned relative to a pedestal section having a cutout of a corresponding shape. Similarly, the cutout portion of the retainer section can be designed to accommodate cookware boxes of various shapes. Other options, such as the use of a clear plastic sheet covering opening 30 are also contemplated.

It will be appreciated that various changes and modifications may be made in the invention to provide the characteristics of the invention without departing from the spirit thereof particularly as defined in the following claims.

What is claimed is:

1. A package for the point-of-purchase display of a product comprising a container section having a bottom wall, upstanding side walls, and a top wall, one of said side walls defining an opening permitting viewing of the product within the container, a pedestal section overlying the bottom wall, said pedestal section including means for holding a product to be displayed, and a retainer section extending upwardly from said pedestal section and having a cutout portion for engagement with product to be displayed, means defined by said pedestal section for fixing the retainer section in position relative thereto, said fixing means comprising slots defined by the pedestal section and receiving tabs defined by said retainer section located within said slots, said pedestal section securing the product against lateral shifting movement, and said retainer section securing the product against vertical shifting movement.

2. A package according to claim 1 wherein each of said container, pedestal and retainer sections are formed from one-piece blanks.

3. A package according to claim 1 wherein said opening in one of said side walls encompasses a large portion of the side wall area.

4. A package according to claim 1 wherein said container section includes a flap extending into the container interior, said flap engaging said retainer section to assist in supporting the retainer section within the container.

5. A package according to claim 1 wherein the top wall of the container section comprises a pivotal cover to permit access to the container interior.

6. A package according to claim 1 wherein said pedestal section defines a central opening for receiving said product, and wherein said retainer section is supported on a diagonal of said container, the cutout portion of said retainer section extending upwardly from said central opening for interfitting with a product received in said opening.

7. A package for the point-of-purchase display of a product comprising a container section having a bottom wall, upstanding side walls, and a top wall, one of said side walls defining an opening permitting viewing of the product within the container, a pedestal section overlying the bottom wall, said pedestal section including means for holding a product to be displayed, and a retainer section extending upwardly from said pedestal section and having a cutout portion for engagement with product to be displayed, said pedestal section securing the product against lateral shifting movement, and said retainer section securing the product against vertical shifting movement, said pedestal section defining a central opening for receiving said product, and wherein said retainer section is supported on a diagonal of said container, the cutout portion of said retainer section extending upwardly from said central opening for interfitting with a produced received in said opening, said product comprising a tea kettle, the handle and spout of the kettle being positioned between said opening in the one side wall and said retainer section whereby all substantial features of the kettle are displayed while the kettle is retained in the package.

8. A package according to claim 7 wherein each of said container, pedestal and retainer sections are formed from one-piece blanks.

9. A package according to claim 7 wherein said container section includes a flap extending into the container interior, said flap engaging said retainer section to assist in supporting the retainer section within the container.

10. A package according to claim 7 wherein the top wall of the container section comprises a pivotal cover to permit access to the container interior.

11. A package according to claim 7 including means defined by said pedestal section for supporting the retainer section thereto.

12. A package according to claim 11 wherein said pedestal section defines slots for receiving tabs defined by said retainer section.

* * * * *